United States Patent [19]

Alford et al.

[11] Patent Number: 4,958,683

[45] Date of Patent: Sep. 25, 1990

[54] METHOD AND APPARATUS FOR TREATING WELLS

[76] Inventors: George W. Alford, 1954 Old Daytona Rd., Daytona Beach, Fla. 32014; William C. Rogers, 1843 Jarrett Dr., Lawrenceville, Ga. 30245

[21] Appl. No.: 336,087

[22] Filed: Apr. 11, 1989

[51] Int. Cl.[5] ..... E21B 37/08

[52] U.S. Cl. ..... 166/247; 166/304; 166/902

[58] Field of Search ..... 166/247, 304, 177, 902

[56] References Cited

U.S. PATENT DOCUMENTS

| | | | |
|---|---|---|---|
| 2,769,921 | 11/1956 | Nahin et al. | 166/247 |
| 3,489,218 | 1/1970 | Means | 166/247 |
| 4,540,052 | 9/1985 | Hitzman | 166/303 |
| 4,638,861 | 1/1987 | Kaushansky | 166/247 |
| 4,765,410 | 8/1988 | Rogers et al. | 166/303 |

*Primary Examiner*—Jerome W. Massie, IV

*Assistant Examiner*—Terry Lee Melius

*Attorney, Agent, or Firm*—James B. Middleton

[57] ABSTRACT

A method for reducing organic contaminants in a well initially breaks down complex organic compounds by radiation with gamma radiation. The remaining materials are subjected to oxygen radicals in the water, the oxygen radicals reacting with the materials to assist in the degradation. A carrier is formed with a plurality of containers fixed together by struts, and each container has a quantity of radioactive material to provide the radiation. Air, oxygen and or peroxide may be fed to the well to provide enough oxygen to produce the oxygen radicals, or the water may be cavitated to free the oxygen in the water.

The apparatus & method may also be adapted with proper shielding for use in surface applications, such as surface water intakes (biofouling by Asiatic clams), general ground water and haz-waste treatment.

10 Claims, 1 Drawing Sheet

METHOD AND APPARATUS FOR TREATING WELLS

It is common in wells for the water supply to be severely restricted, or even terminated completely, due to the clogging of the well screen. While such clogging may be the result of mineral deposits or the like, a common cause of the problem is growth of bacterial colonies in and around the well screen.

The most common prior art efforts at opening clogged wells have included the use of detergents, sometimes used in combination with a surging technique. While such efforts may partially open a clogged well, the prior art techniques are usually not completely successful. Further, in utilizing detergents to break the clogging mass, a heavy concentration of phosphates is frequently included. After treatment is completed there is usually no follow-up to remove the phosphates. It has been found that use of the prior art cleaning techniques may somewhat open a well in the short term, but may exacerbate the problem in the long term due to the residual phosphates.

It has recently been recognized that the cause of much of the problem in wells is the growth of bacterial colonies. The problem, and one solution, are disclosed in U.S. Pat. No. 4,765,410 issued August 23, 1988, and that disclosure is incorporated herein by reference.

It appears that there may be aerobic bacteria in an aquifer, the bacteria being somewhat dormant so that the aquifer is not significantly clogged by such bacteria. With the sinking of a well, however, oxygen is provided in the aquifer, leading to growth of the bacteria. Further, the presence of iron- and/or sulfur-reducing bacteria may not be detected until the well casing and the like provide material to promote the growth of these bacteria.

The above identified patent discloses a method and apparatus for breaking up the biomass created by the bacterial colonies, the technique yielding substantially full flow from the well. The cleanup has been found to be good enough that recleaning is not necessary for a number of years. Insufficient data are available to determine the required recleaning frequency; however, it is expected that there will eventually be sufficient bacterial growth in and around the well that a recleaning will become necessary.

Some efforts have been made in cleaning bio-fouled wells using ionizing radiation to destroy bacteria and remedy other fouling conditions. Such efforts have included simply placing radiation sources in the aquifer, in the vicinity of the well. The object was to kill bacteria and to decompose other contaminants. While the efforts were considered to be successful, high radiation doses were used, and this both increases the cost and increases the danger of accidental radiation contamination of the surrounding area.

SUMMARY OF THE INVENTION

This invention relates generally to well maintenance, and is more particularly concerned with a method and apparatus for maintaining flow in a well and effectively destroying some contaminants in the water.

The present invention provides a method and apparatus wherein a radiation source is placed within a well casing adjacent to the well screen or in a pipe or surface intake. The radiation prevents growth of bacteria on the well screen, and somewhat out in the aquifer. In one preferred embodiment of the invention, a carrier is provided, the carrier including at least one container for receiving a selected quantity of radioactive material for providing a level of radiation. One or more of the containers can be used in a well to vary the pattern of radiation and the dosage.

An additional feature of the present invention is that the radiation will create reactive radicals in the water, and the radicals will react with other contaminants to reduce the hazard. Furthermore, the radiation will directly break down some materials so that either the resulting materials are not as hazardous or the resulting material can be more easily broken down or removed. To enhance the production of reactive radicals, air or gaseous oxygen &/or peroxide may be released in the well below the radiation source. Also, a transducer can be placed in the well to cavitate the water and release free oxygen to promote the above described activity.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
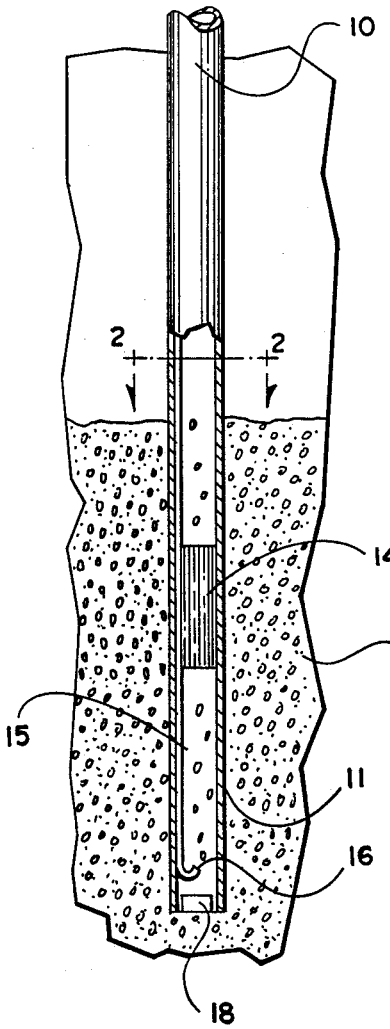
FIG. 1 is a cross-sectional view taken diametrically through a well casing having one form of apparatus made in accordance with the present invention.

Referring now more particularly to the drawings, and to that embodiment of the invention here presented by way of illustration, FIG. 1 shows a well casing 10 having a well screen area 11. The screen area 11 is surrounded by a gravel pack 12. Within the casing 10 there is a carrier generally designated at 14, the carrier including one or more containers as will be discussed in more detail below. The carrier 14 constitutes a radiation source for providing ionizing radiation in the vicinity of the well screen 11.

As illustrated in FIG. 1, there is a pipe 15 that extends down the casing 10, and terminates in an upwardly turned discharge end 16. This pipe 15 can supply air or oxygen to the area below the carrier 14 in the event additional oxygen is needed to assist in the formation of oxygen radicals. Also, a transducer 18 is shown at the bottom of the well casing. The transducer 18 is here shown as a box, but it will be understood by those skilled in the art that any conventional transducer will work well. The only object is to cause some cavitation of the water to release oxygen and assist in the formation of oxygen radicals. It is contemplated that ultrasonic waves may be used, but other energy forms may be used as desired. It is also contemplated that the transducer 18 and the pipe 15 may be used independently or in combination.

Figure 2:
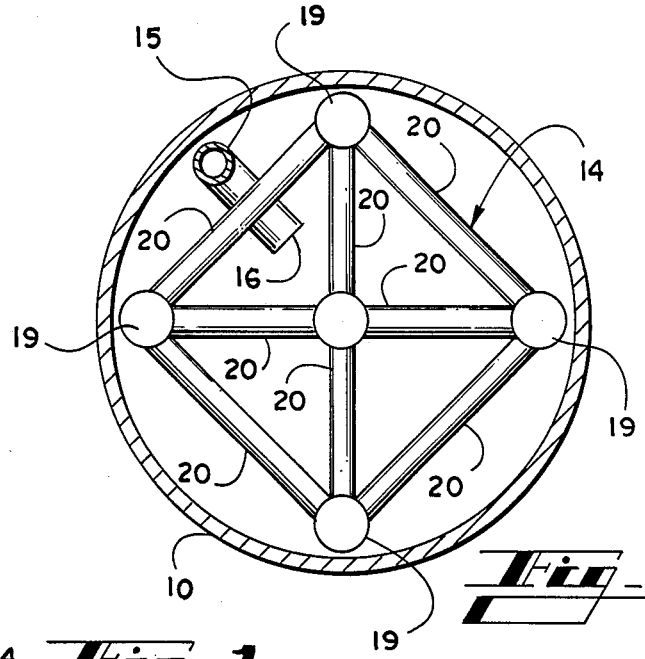
FIG. 2 is an enlarged cross-sectional view taken substantially along the line 2—2 in FIG. 1; and, FIG. 3 is an enlarged, side elevational view, partially in cross-section, showing one container for the radioactive source.

Attention is next directed to FIG. 2 of the drawings for a better understanding of the carrier 14. It will be noticed that the carrier 14 comprises a plurality of containers 19, the containers 19 being held together by structural members 20. As shown in FIG. 1, the carrier is in the form of a square, with a container at each corner of the square and one container in the center of the square, held by diagonally extending struts. The form shown is by way of illustration, but it will be realized that any number of containers 19 may be used in one carrier 14. If a greater radiation dose is required, the carrier may be in the form of a hexagon or an octagon etc. If a smaller dose is needed, the carrier can be triangular, or even a straight line with one to three containers.

Figure 3:
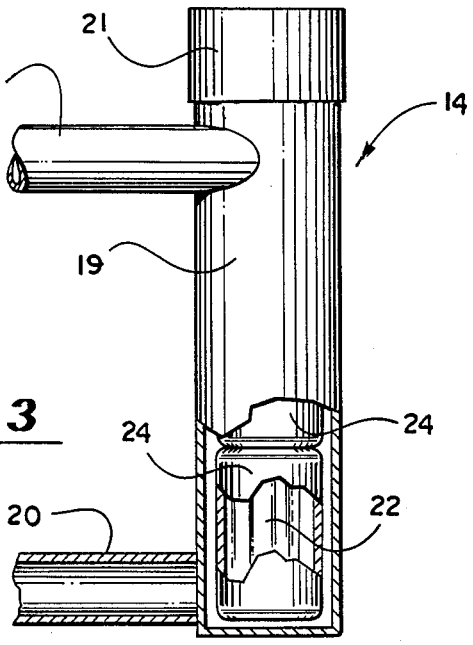

To assure the safety of the carrier of the present invention, the containers 19 will be formed of a durable material such as stainless steel as shown in FIG. 3. The container 19 is a cylindrical member having the structural members 20 fixed directly thereto by welding or the like. A cap 21 selectively closes the container 19. Within the container 19 it will be seen that the radiation source 22 is within another container 24. The source 22 is therefore within a double wall for greater security.

With the above description in mind, it will be understood that the carrier 14 will be lowered into a well casing by an appropriate cable, rod or the like in accordance with known techniques. The carrier 14 will be held in place by any conventional means, including legs on the bottom of the carrier, lugs on the well casing, or any other means desired. The radiation will therefore cover the well screen, and some distance therebeyond to maintain the area free of bacteria.

Considering the method in more detail, one aspect of the method includes the initial cleaning of the well to clear the bio-fouling, using a technique as disclosed in the above identified patent. Following the cleaning, the carrier 14 can be installed in the well casing, and the radiation will prevent attachment of bacteria to the well screen, and will have a kill area somewhat beyond the well screen to assist in keeping the aquifer open. Similarly, the carrier 14 may be used without the initial cleaning, but the radiation dosage may be increased to effect a thorough kill of existing bacteria, then to maintain the bacteria-free state. It should be realized, however, that it may sometimes be better to carry out a prior cleaning actually to remove the clog, before using radiation to kill the bacteria that cause the clog.

Specific dosages must ultimately be a matter for empirical determination; however, tests have indicted that a dosage rate of about $10^{11-12}$ Rads/hour will yield a level kill rate in an infested environment. A dosage of about $10^{5-6}$ Rads/hour will control the environment sufficiently if the area is not badly infested; and, a dosage of about $10^{3-4}$ Rads/hour will prevent attachment to the well screen.

The present invention also provides a very simple and desirable method and apparatus for reducing contamination in wells and surface systems when the contamination is due to organic material other than bacteria. The use of the ionizing radiation both directly breaks down some materials, and indirectly removes other materials.

It has been found that ionizing radiation will break down various organic materials. For example, chemical compounds having more than three benzene rings are broken down to compounds having fewer than three rings, and these simpler compounds are easier to deal with. Similarly, benzene rings will sometimes be opened, thereby allowing easier degradation of the compounds. Radiation can simplify synthetic organic compounds, volatile organic compounds and natural organic compounds, rendering each of these easier to degrade with additional steps.

With the above in mind, it should now be realized that the present invention also provides the radical oxygen species to remove some undesirable materials. Through radiation of the water, and the oxygen in the water, several highly reactive radicals and the like are formed. For example, ozone ($O_3$) and peroxide ($H_2O_2$) will be formed, and radicals such as (OH) will be abundant, all of these reacting with various impurities in the water to clean the water. In some cases, the cleaning will be sufficient; in other cases, the water will be in condition that additional cleaning with substantially conventional processes will render the water usable.

Those skilled in the art will realize that the method and apparatus of the present invention can be used in water wells for potable water, for hazardous waste wells, other wells of various types and surface installation with proper shielding. By varying the radiation dose, the desired changes can be brought about, and known bacteria can be killed and kept away. It is contemplated that the radiation source will be $cobalt_{60}$ or $cesium_{137}$, but other radioactive materials may be equally effective. Gamma radiation will bring about the changes desired without causing any treated material to become radioactive, so the system of the present invention is safe and effective.

It will therefore be understood by those skilled in the art that the embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

We claim:

1. Apparatus for treating a well, said well including a well casing, and a well screen at the lower end of said casing, the arrangement being that liquid enters said well casing through said well screen, and said liquid is moved up said well casing, said apparatus including a carrier held within said well casing adjacent to said well screen, said carrier including at least one container, said container having a radiation source therein for irradiating said well screen sufficiently to prevent growth of bacteria thereon, and further including means for providing generally free oxygen within said liquid for producing oxygen radicals on irradiation by said radiation source.

2. Apparatus as claimed in claim 1, said carrier comprising a plurality of said containers, and a plurality of struts for fixing each container of said plurality of containers to other containers of said plurality of containers.

3. Apparatus as claimed in claim 2, said containers being mounted at the angles of a regular polygon, the polygon being of a size to be received within said well casing.

4. Apparatus as claimed in claim 1, said means for providing free oxygen within said liquid including pipe means within said well casing for conducting oxygen-containing gas into said well to a point below said carrier, the arrangement being such that said oxygen-containing gas passes said carrier as said liquid moves up said well casing, and said radiation creates oxygen radicals in said liquid.

5. Apparatus as claimed in claim 1, said means for providing free oxygen within said liquid including a transducer within said well casing for cavitating said liquid and releasing oxygen gas from said liquid into said well to a point below said carrier, the arrangement being such that said oxygen gas passes said carrier as said liquid moves up said well casing, and said radiation creates oxygen radicals in said liquid.

6. A method for reducing contamination in the liquid in a well, said liquid containing undesirable organic compounds, said well including a well casing and a well screen at the lower end of said well casing, said method including the steps of placing a source of ionizing radiation within said well casing adjacent to said well screen, said source of ionizing radiation being so placed that liquid in said well must pass said source in exiting from said well, and providing generally free oxygen in said liquid, said source of radiation being sufficient to prevent growth of bacteria on said well screen and to create oxygen radicals in said liquid from said generally free oxygen, and including the step of irradiating said liquid for breaking down said organic compounds and providing simpler compounds, and subjecting said simpler compounds to said oxygen radicals for reaction therewith for reducing said contamination.

7. A method as claimed in claim 6, said step of providing generally free oxygen in said liquid, including the step of conducting oxygen-containing gas into said well to a point below said source of radiation.

8. A method as claimed in claim 7, said oxygen containing gas being air.

9. A method as claimed in claim 7, said oxygen containing gas being substantially pure oxygen.

10. A method as claimed in claim 6, said step of providing generally free oxygen in said liquid comprising the step of cavitating said liquid for releasing oxygen contained therein.

* * * * *